United States Patent [19]

Hopkins

[11] Patent Number: 4,810,355

[45] Date of Patent: Mar. 7, 1989

[54] PROCESS FOR PREPARING DEHAZED WHITE OILS

[75] Inventor: P. Donald Hopkins, St. Charles, Ill.

[73] Assignee: Amoco Corporation, Chicago, Ill.

[21] Appl. No.: 175,743

[22] Filed: Mar. 31, 1988

Related U.S. Application Data

[63] Continuation of Ser. No. 808,452, Dec. 12, 1985, abandoned.

[51] Int. Cl.[4] ..... C10G 45/00; C10G 67/00; C10G 47/00

[52] U.S. Cl. ..... 208/58; 208/57; 208/89; 208/97; 208/110; 208/111; 208/14

[58] Field of Search ..... 208/57, 58, 89, 97, 208/110, 111, 14, 18

[56] References Cited

U.S. PATENT DOCUMENTS

| | | | |
|---|---|---|---|
| 3,132,086 | 5/1964 | Kelley et al. | 208/57 |
| 3,629,096 | 12/1971 | Divijak Jr. | 208/89 |
| 3,700,585 | 10/1972 | Chen et al. | 208/111 |
| 3,758,403 | 9/1973 | Rosinski et al. | 208/120 |
| 3,841,995 | 10/1974 | Bertolacini et al. | 208/89 |
| 3,882,049 | 5/1975 | Bertolacini et al. | 208/89 |
| 4,483,764 | 11/1984 | Hensley, Jr. et al. | 208/111 |
| 4,486,296 | 12/1984 | Oleck et al. | 208/89 |
| 4,563,266 | 1/1986 | Hopkins et al. | 208/111 |
| 4,597,854 | 7/1986 | Penick | 208/58 |
| 4,648,957 | 3/1987 | Graziani et al. | 208/58 |

*Primary Examiner*—Helen M. S. Sneed
*Assistant Examiner*—Chung K. Pak
*Attorney, Agent, or Firm*—Ekkehard Schoettle; William H. Magidson; Ralph C. Medhurst

[57] ABSTRACT

The process of the invention relates to the production of dehazed white oil possessing long-term low temperature storage stability. The white oil is dehazed with a dehazing catalyst comprising a Group VIII metal incorporated with a shape-selective molecular sieve selected from the Group consisting of a ZSM-5 type zeolite and a crystalline borosilicate molecular sieve.

10 Claims, No Drawings

PROCESS FOR PREPARING DEHAZED WHITE OILS

CROSS-REFERENCE TO RELATED APPLICATIONS

The present application is a continuation of application Ser. No. 808,452 filed Dec. 12, 1985, now abandoned.

BACKGROUND OF THE INVENTION

The process of the present invention relates to the refining of lubricating oils and derivatives therefrom.

In the past, lubricating oils and derivatives therefrom have been refined by employing a finishing treatment using clay or a combination of sulfuric acid and clay. In many cases, the feedstock had been solvent or catalytically dewaxed and/or solvent extracted. Such finishing treatments provided a treated product that possessed improved color and odor and, in many cases, improved stability to light and oxidation. In general, stability to oxidation and to light has been maintained by the addition of one or more chemicals to the finished product. In recent years, the quality of lubricating oils has been improved by a finishing treatment comprising a relatively severe hydrogenation treatment.

One of the important applications of hydrotreating a lubricating oil distillate is the hydrotreating of mineral oils to produce "white oils." A white oil is a highly refined lubricating oil fraction which is colorless, odorless, and tasteless; and it must be essentially free of aromatic hydrocarbons. It must have a color of +30 Saybolt and must possess a low absorbance of ultraviolet light. Typically white oils can be used for cosmetics and certain medicinal purposes.

The hydrogenation treatment of a lubricating oil fraction to produce a white oil, in general, comprises a two-stage process. In the first stage of a typical process, the selected lubricating oil fraction is desulfurized over a sulfactive hydrogenation catalyst under relatively severe hydrogenation conditions, and the effluent from this first stage is contacted in a second stage with hydrogen under relatively mild conditions with a hydrogenation catalyst comprising a platinum group metal on a non-acidic or a weakly-acidic support.

For instance, U.S. Pat. No. 3,841,995 (Bertolacini et al.) the teachings of which are incorporated herein by reference, discloses a two-zone hydrogenation process for producing a colorless mineral oil by hydrogenating and desulfurizing a lubricating oil distillate with a sulfactive hydrogenation catalyst in a first reaction zone and by contacting the first-reaction zone effluent in a second reaction zone with hydrogen and a catalyst containing a Group VIII noble metal deposited on a large-pore-diameter alumina having a surface area of 150–500 $m^2/g$ and an average pore diameter of 100–200 Angstroms. The lubricating oil distillate feed in the Bertolacini et al. process is initially dewaxed and may also be solvent-extracted to reduce its aromatic hydrocarbon content.

U.S. Pat. No. 4,269,695 (Silk et al.) discloses a process for reclaiming wax-contaminated lube base stock oils which process consists of contacting the oil with hydrogen in a single reaction zone at a temperature of 500° to 675° F., a hydrogen partial pressure of about 100 to 1500, and at a space velocity higher than 2 and up to about 10. The catalyst used in the reaction zone is a crystalline alumino silicate zeolite having a silica to alumina ratio of at least 12 and a Constraint Index of about 1 to about 12, i.e. a ZSM-5 type zeolite.

U.S. Pat. No. 4,263,127 (Rausch et al.) relates to the preparation of food grade white mineral oils of suitable viscosity in high yield from a mineral oil distillate of suitable lubricating oil viscosity. The Rausch et al. process comprises contacting the distillate with hydrogen in three catalytic stages to yield a refined lubricating oil from which white mineral oil is recovered. The first reaction stage employs hydrocracking conditions. Subsequent reaction stages employ hydrogenation conditions, first with a sulfur-resistant hydrogenation catalyst and finally with a platinum group metal-containing selective hydrogenation catalyst, optionally activated with a halogen. The last selective hydrogenation step is carried out at from about 450° F. to about 650° F., and a pressure in the range from about 1000 psig to about 5000 psig. The selective hydrogenation catalyst comprises a Group VIII platinum group metal on a support comprising calcined or activated alumina.

U.S. Pat. No. 4,325,804 (Everett et al.) also relates to the preparation of high quality, e.g., high viscosity index, base lubricating oils and white oils, particularly food grade white mineral oils, of suitable viscosity in high yield from a mineral oil distillate of suitable lubricating oil viscosity. The Everett et al. process comprises contacting the distillate with hydrogen in four catalytic stages. The first reaction stage employs hydrocracking conditions. Subsequent reaction stages employ hydrogenation conditions. The second reaction stage preferably employs a sulfur-resistant hydrogenation catalyst and produces a product suitable as a high quality lubricating oil base stock. The third reaction stage preferably employs a sulfur-resistant hydrogenation catalyst to obtain further aromatic saturation. The final stage employs a selective hydrogenation catalyst, optionally activated with a halogen, and produces a product suitable as a white oil, preferably a food grade white oil. Patentees' selective hydrogenation step is carried out at a temperature within the range of 500° F. to 575° F. and a pressure of 2,000 psig. to about 3,000 psig. The selective hydrogenation catalyst comprises a platinum group metal on an activated or calcined alumina.

While the above white oil preparation processes are acceptable, one of the problems arising from the preparation of white oils and particularly medicinal or food grade white oils is the formation of an unsightly waxy haze also known as solid paraffins during long-term low temperature storage. For instance, a refined oil can be prepared which is clear and bright and which has a satisfactory cloud point and pour point but upon storage at a low temperature above the cloud point a wax haze develops which makes the oil aesthetically unattractive and often commercially unacceptable.

Medicinal and food grade white oils must meet stringent U.S. Pharmacopoeia and Food and Drug Administration specifications. These specifications generally preclude blending of on-specification materials with off-specification materials. Thus the refiner has had few options other than to reprocess the off-specification material, for instance, by feeding it to a catalytic cracking unit.

When a refined product fails a haze test, it is particularly expensive for the refiner since the raw material and process costs have been expended to make the product. The amount of haze present e.g. typically less than 2 wt. % wax contaminant must be removed without impairing other properties and meeting the pertinent white oil specifications. In this connection, the Silk et al. process is unacceptable since its conditions produce products which do not meet the aromatics specifications for white oils. Specifically, the temperatures used in the Silk et al. process are too high to ensure hydrogenation of all aromatics. Temperatures above 500° F. change the equilibrium constraints, such that the presence of aromatics is preferred.

In any event there is a need for a process that will remove minor amounts of haze or solid paraffins from medicinal grade white oils or other technical grade white oils without an inordinate yield loss or detrimental effect on the other specified white oil properties.

Accordingly, it is an object of the present invention to provide a process to produce haze-free white oils. Another object is to provide a process for haze removal from a white oil whether technical or medicinal grade, which process provides a minimal yield debit, does not impair the white oils' other pertinent specifications, and remains haze-free for a long-term low temperature storage.

SUMMARY OF THE INVENTION

In one embodiment, the process of the present invention provides for a process for preparing a haze-free white mineral oil. This process involves contacting a dewaxed lube oil distillate with a sulfactive hydrogenation catalyst in the presence of hydrogen under hydrogenation and desulfurization conditions to produce a desulfurized effluent.

The hydrogenated effluent is then contacted in the presence of hydrogen with a hydrogenation catalyst. The hydrogenated effluent is then contacted with a dehazing catalyst comprising a Group VIII metal incorporated with a shape-selective molecular sieve component in the presence of hydrogen under selected hydrogenation conditions.

In a specific embodiment of the present invention, the sulfactive hydrogenation catalyst is disposed in a first reaction zone and the desulfurized effluent is passed to a second reaction zone which contains a physical catalyst mixture. This catalyst mixture contains about 50 to about 90 wt % of the hydrogenation catalyst and about 10 to about 50 wt. % of the dehazing catalyst.

In yet another embodiment, the process of the present invention involves dehazing a white mineral oil by contacting the white mineral oil with a dehazing catalyst comprising a Group VIII metal incorporated with a shape-selective molecular sieve component in the presence of hydrogen under selected hydrogenation conditions.

DETAILED DESCRIPTION OF THE INVENTION

According to the present invention, there is provided a process for the production of a dehazed colorless white oil. This process comprises contacting a dewaxed mineral lubricating oil or fraction thereof in a first reaction zone with a sulfactive hydrogenation catalyst in the presence of hydrogen under hydrogenation and desulfurization conditions to produce a desulfurized effluent. This desulfurized effluent is subsequently contacted with both a hydrogenation catalyst and a dehazing catalyst in the same or separate respective reaction zones i.e., the hydrogenation and dehazing are carried out either sequentially or simultaneously.

The catalyst that is employed in the first reaction zone of the process of the present invention is a sulfactive hydrogenation catalyst. Examples of such a catalyst are (1) a catalyst comprising a Group VIII metal and a Grou VIB metal, either in the form of the elements or compounds thereof, deposited upon a non-acidic support or a weakly-acidic support, such as alumina, (2) a catalyst comprising a Group VIII metal or Group VIB metal in the form of elements or as compounds thereof, deposited upon a non-acidic or weakly-acidic catalyst support material.

The preferred Group VIII and Group VIB metals are nickel and molybdenum respectively.

The operating conditions that are employed in the first reaction zone of the process of the present invention comprise an elevated pressure of up to 5,000 p.s.i.g., a temperature of about 600° F. to 1,000° F., a liquid hourly space velocity (LHSV) as large as 5 volumes of hydrocarbon per hour per volume of catalyst and a hydrogen circulation rate as high as 25,000 SCFB.

The hydrogenation catalyst employed in a subsequent reaction zone comprises a Group VIII metal deposited on a refractory inorganic oxide such as a large-pore-diameter alumina having a surface area of about 150 square meters per gram to about 500 square meters per gram and an average pore diameter of about 100 A. to about 200 A. as described in U.S. Pat. No. 3,841,995 (Bertolacini et al.) and incorporated herein by reference.

As mentioned above, one of the components of the hydrogenation catalyst is a Group VIII metal with the Group VIII noble metals being preferred. The Group VIII noble metals are palladium, platinum, rhodium, iridium, ruthenium, and osmium. The preferred Group VIII noble metal is palladium.

Suitably, the average pore diameter of the preferred large-pore-diameter alumina should be at least 120 A. Preferably, the average pore diameter of the alumina that is employed in the catalytic composition of the present invention is at least 130 A. The surface area of this large-pore-diameter alumina should be within the range of about 150 square meters per gram to about 500 square meters per gram. Suitably, the surface area is at least 200 square meters per gram. Preferably, the surface area is at least 300 square meters per gram.

The hydrogenation catalyst may also contain minor amounts of other components which do not adversely affect the performance of the catalyst for the hydrogenation and finishing of mineral lubricating oil distillates. An example of such a component is silica, which may be present in an amount of no more than 5 weight percent and which may provide a stabilizing effect upon the catalyst.

The hydrogenation catalyst can be prepared by several methods. A Group VIII noble metal can be added in the form of a soluble salt of that Group VIII noble metals to either a hydrosol or hydrogel of the alumina and the resulting composite subsequently blended, dried, and calcined. As an alternative, either extrudates or pellets of the alumina may be impregnated with an aqueous solution of the selected Group VIII noble metals. When the Group VIII noble metal is palladium, its salts may be any commercially-available salt or palladium metal solubilized by aqua regia. The impregnated composite may then be dried and calcined.

The Group VIII noble metal is present in an amount within the range of about 0.1 wt. % to about 2 weight percent, based on the weight of the catalytic composition. Preferably, no more than 1 wt. % of the Group VIII noble metal is employed.

The dehazing catalyst situated in a subsequent reaction zone or the same reaction zone with the hydrogenation catalyst according to the present invention comprises a shape-selective molecular sieve component and at least one Group VIII metal hydrogenation component. For purposes hereof, a shape-selective molecular sieve component is defined as a crystalline molecular sieve component having substantial cracking activity with respect to n-paraffins and near normal isoparaffins, but only insubstantial cracking activity with respect to branched paraffins having long side chains and cyclic components such as naphthenes and aromatics. A shape-selective molecular sieve component has a pore size that permits the entry of normal aliphatic compounds and slightly branched aliphatic compounds and substantially exclude all compounds containing at least a quaternary carbon atom and compounds having a molecular dimension equal to or substantially greater than a quaternary carbon atom wherein said pore size is about 5 angstroms. Such shape-selective components often are synthesized in alkali metal form, i.e., with alkali metal cations associated with framework metal ions. However, for purposes hereof, the shape-selective component must be in acid, ammonium or polyvalent metal ion-exchanged form in order to provide suitable cracking activity. The acid form is preferred.

One class of borosilicate molecular sieve useful as the shape-selective component of the catalysts employed according to the present invention is the shape-selective crystalline borosilicates of the AMS type. Such materials have the following composition in terms of mole ratios of oxides:

$$0.9\pm0.2\ M_{2/n}O:B_2O_3:YSiO_2:ZH_2O$$

wherein M is at least one cation having a valence of n, Y ranges from about 4 to about 600 and Z ranges from 0 to about 160, and provide an X-ray diffraction pattern comprising the following X-ray diffraction lines and assigned strengths.

| d (A°) | Assigned Strength |
|---|---|
| 11.2 ± 0.2 | W-VS |
| 10.0 ± 0.2 | W-MS |
| 5.97 ± 0.07 | W-M |
| 3.82 ± 0.05 | VS |
| 3.70 ± 0.05 | MS |
| 3.62 ± 0.05 | M-MS |
| 2.97 ± 0.02 | W-M |
| 1.99 ± 0.02 | VM-M |

Such crystalline borosilicates typically are prepared by reaction of boron oxide and a silicon-containing material in a basic medium. Further details with respect to these shape-selective crystalline borosilicate components are found in commonly assigned U.S. Pat. No. 4,269,813 (Klotz), which is incorporated herein by reference, wherein the AMS-1B crystalline borosilicate molecular sieve is disclosed.

AMS-1B crystalline borosilicate molecular sieves can also be prepared by crystallizing a mixture of an oxide of silicon, an oxide of boron, an alkylammonium compound and ethylenediamine. This method is carried out in a manner such that the initial reactant molar ratios of water-to-silica range from about 5 to about 25, preferably about 10 to about 22, and most preferably about 10 to about 15. In addition, preferable molar ratios for initial reactant silica-to-oxide of boron range from about 4 to about 150, more preferably about 5 to about 80, and most preferably about 5 to about 20. The molar ratio of ethylenediamine-to-silicon oxide used in the preparation of AMS-1B crystalline borosilicate should be above about 0.05, typically below about 5, preferably about 0.1 to about 1.0, and most preferably about 0.2 to about 0.5. The molar ratio of alkylammonium template compound or precursor-to-silicon oxide useful in the instant preparation can range from 0 to about 1 or above, typically above about 0.001, preferably about 0.05 to about 0.1, and most preferably from about 0.005 to about 0.02. The silica source is preferably a low-sodium-content silica source containing less than 2 containing less than 2,000 ppmw, and most preferably containing less than 1,000 ppmw, such as Ludox AS-40 which contains 20 wt. % $SiO_2$ and 0.08 wt. % $Na_2O$ or Nalco 2327 which has similar specifications.

It is noted that the preferable amount of alkylammonium template compound used in the instant preparation method is substantially less than that required to produce AMS-1B conventionally using an alkali metal cation base. The borosilicate prepared by the instant method typically contains at least 9,000 ppmw boron and less than about 100 ppmw sodium and is designated as HAMS-1B-3. The HAMS-1B-3 crystalline borosilicate has a higher boron content and a lower sodium content than crystalline borosilicates formed using conventional techniques.

A second useful class of shape selective molecular sieve cracking components useful according to the present invention is the shape selective crystalline aluminosilicates molecular sieves of the ZSM-type. Suitable crystalline aluminosilicates of this type typically have silica to alumina mole ratios of at least about 12:1 and pore diameters of at least 5 Å. A specific example of a useful crystalline aluminosilicate of the ZSM type is crystalline aluminosilicate ZSM-5, which is described in detail in U.S. Pat. No. 3,702,886. Other shape-selective cracking components contemplated according to the invention include crystalline aluminosilicate ZSM-11, which is described in detail in U.S. Pat. No. 3,709,979; crystalline aluminosilicate ZSM-12, which is described in detail in U.S. Pat. No. 3,832,449; crystalline aluminosilicate ZSM-35, which is described in detail in U.S. Pat. No. 4,016,245; and crystalline aluminosilicate ZSM-38, which is described in detail in U.S. Pat. No. 4,046,859. All of the aforesaid patents are incorporated herein by reference. A preferred crystalline aluminosilicate zeolite of the ZSM type is crystalline aluminosilicate ZSM-5, owing to its desirable selectivity and cracking activity.

A third class of shape-selective cracking components useful in the catalysts employed in the process of the present invention is the mordenite-type crystalline aluminosilicate molecular sieves. Specific examples of these are described in detail in U.S. Pat. No. 3,247,098 (Kimberlin), U.S. Pat. No. 3,281,483 (Genesi et al.) and U.S. Pat. No. 3,299,153 (Adams et al.), all of which are incorporated herein by reference. Synthetic mordenite-type molecular sieves such as those designated Zeolon and available from the Norton Company are also suitable according to the invention process.

Although not required, it is preferred to employ the above-described shape-selective molecular sieve component dispersed in a matrix of at least one non-molecular sieve, porous refractory inorganic oxide matrix component as the use of such a matrix component facilitates the provision of the ultimate catalyst in a shape or form well suited for process use. Useful matrix components include alumina, silica, silica-alumina, zirconia, titania, etc., and various combinations thereof. The matrix component also can contain various adjuvants such as phosphorus oxides, boron oxides and/or halogens such as fluorine or chlorine. Usefully, the molecular sieve-matrix dispersion contains about 5 to about 70 wt % zeolite component and about 30 to about 95 wt % matrix component.

Methods for dispersing molecular sieve materials within a matrix component are well known to persons skilled in the art and applicable with respect to the shape-selective molecular sieve materials employed according to the present invention. A preferred method is to blend the shape-selective molecular sieve component, preferably in finely-divided form, in a sol, hydrosol or hydrogel of an inorganic oxide, and then add a gelling medium such as ammonium hydroxide to the blend with stirring to produce a gel. The resulting gel can be dried, shaped if desired, and calcined. Drying preferably is conducted in air at a temperature of about 80° to about 350° F. (about 27° to about 177° C.) for a period of several seconds to several hours. Calcination preferably is conducted by heating in air at about 800° to about 1,200° F. (about 427° to about 649° C.) for a period of time ranging from about ½ to about 16 hours.

Another suitable method for preparing a dispersion of shape selective molecular sieve component in a porous refractory oxide matrix component is to dry blend particles of each, preferably in finely-divided form, and then shape the dispersion, if desired.

Relative proportions of the shape selective molecular sieve component and hydrogenating component of the catalysts are such that at least a catalytically effective amount of each is present. Preferably, catalysts employed according to the invention contain about 10 to about 70 wt % based on total catalyst weight of the molecular sieve component and about 0.1 to about 20 wt % of the hydrogenating component. More preferably, molecular sieve component concentration ranges from about 30 to about 70 wt % in order to attain a desirable degree of selective cracking activity while avoiding inclusion in the catalyst of amounts of molecular sieve component that unduly increase the cost of the ultimate catalyst. When the molecular sieve component is employed as a dispersion in a matrix component, preferred matrix component content ranges from about 30 to about 70 wt % based on total catalyst weight.

The hydrogenation component of the dehazing catalyst employed according to the present invention comprises Group VIII metals. The metal components can be present in elemental form, as oxides or sulfides, or as mixtures thereof. Useful Group VIII metals include iron, cobalt, nickel, ruthenium, rhodium, palladium, osmium, iridium, and platinum. Among these, palladium and platinum are most preferred owing to their superior hydrogenating activities. Group VIII metal content, calculated as divalent metal oxide in the case of cobalt, nickel and/or iron, preferably ranges from about 0.1 to about 10 wt. % with about 0.5 to about 5 wt. % being more preferred in terms of hydrogenation activity. Higher levels of metals can be employed if desired though the degree of improvement resulting therefrom typically is insufficient to justify the added cost of the metals.

The hydrogenating component of the dehazing catalyst employed according to this invention can be associated with the shape selective molecular sieve component by impregnation of the molecular sieve component, or molecular sieve component dispersed in a porous refractory inorganic oxide matrix, with one or more solutions of compounds of the metals of the hydrogenating component which compounds are convertible to oxides on calcination. It also is contemplated, however, to impregnate a porous refractory inorganic oxide matrix component with such solutions of the metal components and then blend the molecular sieve component with the resulting impregnation product. Accordingly, the present invention contemplates the use of catalysts in which the hydrogenating component is deposed on the molecular sieve component or on a molecular sieve-matrix component dispersion or on the matrix component of a molecular sieve-matrix dispersion.

The mechanics of impregnating the molecular sieve component, matrix component or molecular sieve matrix composite with solutions of compounds convertible to metal oxides on calcination are well known to persons skilled in the art and generally involve forming solutions of appropriate compounds in suitable solvents, preferably water, and then contacting the molecular sieve matrix component or molecular sieve matrix dispersion with an amount or amounts of solution or solutions sufficient to deposit appropriate amounts of metal or metal salts onto the molecular sieve or molecular sieve-matrix dispersion. Useful metal compounds convertible to oxides are well known to persons skilled in the art and include various ammonium salts, as well as metal acetates, nitrates, anhydrides, etc.

The original cations associated with the molecular sieve, i.e., the alkali metal cations, ammonium cations, or hydrogen cations, can be replaced at least in part by ion exchange with hydrogenation metal component-containing ions by techniques which are known in the art. Ion-exchange techniques known in the art are disclosed in many patents including U.S. Pat. Nos. 3,140,249, 3,140,250, and 3,140,253, the teachings of which are incorporated by reference into this specification.

The dehazing step may be carried out prior to the hydrogenation step, subsequent thereto or simultaneously with the hydrogenation step.

The above-described hydrogenation and dehazing catalysts can be employed in any suitable form such as spheres, extrudate, pellets, C-shaped or cloverleaf-shaped particles.

In a specific embodiment of the present invention, the dehazing and the hydrogenation catalyst are present in the same reaction zone designated as the second reaction zone and hydrogenation and dehazing are carried out simultaneously.

The portion of catalyst in the second reaction zone which is dehazing catalyst ranges from about 10 to about 50 wt. %, with the preferred range ranking from about 15 to about 35 wt. %. This portion dehazing catalyst in the second reaction zone can be varied in order to effect the required dehazing with a minimal yield loss. The dehazing catalyst can be located at the upstream or downstream end of the second reaction zone or be in a physical mixture with the hydrogenation catalyst throughout the second reaction zone.

Alternatively, in another specific embodiment of the present invention to minimize yield losses the dehazing catalyst can be situated in a separate "tail reactor" and used only when necessary for haze removal of the white oil. In the present embodiment of the invention a white oil otherwise meeting the FDA specifications for either technical or medicinal grade white oils, but containing a haze is dehazed while retaining the other requisite FDA specifications for the white oil. The haze test designating a dehazed white oil is set out in the UNITED STATES PHARMACOPOEIA XX (1980) at pp. 532–533 and is designated as the solid paraffin test. The pertinent FDA white oil specifications can be found at 21 C.F.R. 178.3620 for technical grade oil and 21 C.F.R. 172.878 for food grade oil.

The preferred operating conditions in the second reaction zone or for both the separate dehazing and separate hydrogenation zones generally comprise: about 400° to about 475° F., about 1000 to about 2000 psig hydrogen partial pressure, and a LHSV of about 0.1 to about 1.0. The preferred narrow ranges include a temperature of about 450° to 475° F., a hydrogen partial pressure of about 1500 to 2000 psig and a LHSV of about 0.2 to 0.6.

The dehazing or second reaction zone conditions have been carefully selected to afford preparation of a product meeting pertinent FDA white oil specifications. In particular the relatively higher pressures and lower space velocities are necessary to effect the saturation of any aromatics which may be present.

Temperatures less than 500° F. and in the preferred range prescribed by the invention are required to maintain the equilibrium constraints such that aromatics are or remain hydrogenated. For instance, as previously mentioned, the dehazing process as taught in U.S. Pat. No. 4,269,695 would result in a product not meeting white oil specifications because the relatively higher temperatures, lower pressures and higher space velocities taught therein would result in a product containing a greater amount of aromatics than permitted by FDA white oil specifications.

White oils dehazed in accordance with the process of the invention not only possess all of the requisite FDA mandated specifications but also can be subjected to long term low temperature storage without haze formation. In the context of the present invention, the terms "long term low temperature storage stability" pertain to a white oil that can remain haze-free after 1 year of storage at 4° C.

Any mineral lubricating oil distillate may be treated in the process of the present invention. The feedstock might be a light lubricating oil, or it could be a heavy lubricating oil. The viscosity of the oil could have a value as low as about 40 Saybolt seconds at 100° F. On the other hand, the feedstock can have a viscosity as high as SAE 60. In general, the feedstock has been dewaxed and/or solvent extracted. In some cases, it may have been previously subjected to a mild hydrogenation treatment to reduce the amount of sulfur in the recycle gas and to help regulate the heat effect of a high aromatics content although feeds having as much as 500 ppmw and 0.3 wt. % can be charged to the first reaction zone of the invention process.

The feedstocks may have been solvent extracted to remove aromatics. Of the various solvent extraction processes, the most prevalent solvent employed is phenol. Other solvents employed include low boiling point autorefrigerative hydrocarbons, such as propane, propylene, butane, pentane, etc., liquid sulfur dioxide, furfural, and N-methyl-2-pyrrolidone (NMP). NMP is a preferred solvent because it is less toxic than the above-mentioned solvents and requires less energy to effect the extraction.

The solvent, or NMP, extraction step is carried out to extract a portion of the aromatics present in the hydrocarbon feed. Optionally the raffinate phase can be processed to remove any entrained and dissolved solvent.

Solvent ratios vary from 0.5 volumes solvent recycled per volume of feed to 5 volumes solvent recycled per volume feed. Extraction is typically carried out in a number of counter-current washing stages. Columns containing perforated plates, bubble caps, and channel are often employed. Another typical contacting device is a Shell rotating disc contactor. The subject contactor consists of a vertical vessel fitted with a series of stator rings fixed to the wall together with a central rotating shaft carrying a number of discs, one to each of the compartments formed by the stator rings.

The feedstock has also been either solvent dewaxed, e.g., utilizing toluene, methyl ethyl ketone, or propane or catalytically dewaxed in a manner known to those skilled in the art.

Suitable catalytic dewaxing processes include catalytic dewaxing of petroleum and synthetic crude oil fractions in the presence of shape-selective catalysts capable of selectively cracking n-paraffins. For example, U.S. Pat. No. Re. 28,398 (Chen et al.), which is a reissue of U.S. Pat. No. 3,700,585, discloses the use of shape-selective crystalline aluminosilicate zeolite ZSM-5 in catalytic dewaxing processes directed at removing high freezing point paraffins from jet fuel to lower the freezing point, improving the octane rating of naphtha fractions and lowering the pour point of lube oil base stocks. According to Chen et al., the shape selective cracking ability of crystalline aluminosilicate ZSM-5 permits selective cracking of n-paraffins and certain isoparaffins without substantial cracking of desirable feed components such that improved catalytic dewaxing products are obtained under both hydrotreating and hydrocracking conditions. Chen et al. also disclose the use of crystalline aluminosilicate zeolite ZSM-5 associated with hydrogenating metals such as tungsten, vanadium, molybdenum, rhenium, nickel, cobalt, chromium, manganese, platinum or palladium, such metals being associated with the zeolite by exchange or impregnation.

U.S. Pat. No. Re. 30,529, which is a reissue of U.S. Pat. No. 4,100,056, discloses catalytic dewaxing of atmospheric and vacuum distillates in the presence of a catalyst containing mordenite in hydrogen form and a Group VI or VIII metal to obtain naphthenic lube oils of intermediate viscosity index and pour points ranging from −50° to ±20° F.

Other suitable catalytic dewaxing processes are disclosed in U.S. Pat. Nos.: 4,222,855 (Pelrine et al.), 4,247,388 (Banta et al.), 4,251,348 and 4,282,085 (both O'Rear) 4,259,174 (Chen et al.), 4,360,419 (Miller), 4,343,692 (Winquist), 4,388,177 (Bowes et al.), 4,390,414 (Cody), 4,176,050 (Chen et al.), 4,153,540 (Gorring et al.), and 3,968,024 (Gorring et al.).

A preferred method of dewaxing is disclosed in U.S. Ser. No. 686,077 filed Dec. 24, 1984 and incorporated herein by reference which method involves dewaxing with a catalytic composition comprising a crystalline borosilicate molecular sieve and at least one Group VIII noble metal hydrogenation component.

The borosilicate-containing dewaxing catalyst is generally more nitrogen resistant than conventional aluminosilicate-containing dewaxing catalysts, however, basic nitrogen compounds, such as NMP contained in NMP-extracted raffinates, can result in premature deactivation of the borosilicate dewaxing catalyst. Thus, in a preferred mode of operation, the effluent from an NMP extraction zone is hydrotreated to reduce the amount of nitrogen, specifically basic nitrogen compounds, contained in the dewaxing zone influent. The sulfur content of the dewaxing zone influent is reduced in the hydrotreating zone, thereby reducing any sulfur poisoning of the hydrogenation component in the dewaxing catalyst. It is believed this results in increased aromatics saturation in the dewaxing zone resulting in an increase in VI of the lube base stock.

Suitable operating conditions in the hydrotreating zone are summarized in Table 1.

TABLE 1

HYDROTREATING OPERATING CONDITIONS

| Conditions | Broad Range | Preferred Range |
|---|---|---|
| Temperature, °F. | 400–850 | 500–750 |
| Total pressure, psig | 50–4,000 | 400–1500 |
| LHSV | .10–20 | .25–2.5 |
| Hydrogen rate, SCFB | 500–20,000 | 800–6,000 |
| Hydrogen partial pressure, psig | 50–3,500 | 500–1,000 |

The hydrotreater is also preferably although not necessarily operated at conditions that will result in a liquid effluent stream having less than 10 ppmw nitrogen-containing impurities, based on nitrogen, and less than 20 ppmw sulfur-containing impurities, based on sulfur, and most preferably less than 5 ppmw and 10 ppmw, respectively. The above-set out preferred nitrogen and sulfur contents correspond to substantial conversion of the sulfur and nitrogen compounds entering the hydrotreater.

The catalyst employed in the hydrotreater can be any conventional and commercially available hydrotreating catalyst. The subject hydrotreating catalysts typically contain one or more elements from Groups IIB, VIB, and VIII supported on an inorganic refractory support such as alumina. Catalysts containing NiMo, NiMoP, CoMo, CoMoP, and NiW are most prevalent.

Other suitable hydrotreating catalysts for the hydrotreating stage of the present invention comprise a Group VIB metal component or a non-noble metal component of Group VIII and mixtures thereof, such as cobalt, molybdenum, nickel, tungsten and mixtures thereof. Suitable supports include inorganic oxides such as alumina, amorphous silica-alumina, zirconia, magnesia, boria, titania, chronia, beryllia, and mixtures thereof. The support can also contain up to about 20 wt. % zeolite based on total catalyst weight. A preferred hydrotreating catalyst contains sulfides or oxides of Ni and Mo composited with an alumina support wherein the Ni and Mo are present in amounts ranging from 0.1 to 10 wt %, calculated as NiO, and 1 to 20 wt %, calculated as $MoO_3$, based on total catalyst weight.

Prior to the dewaxing in accordance with a preferred aspect of the present invention, the $H_2S$ and $NH_3$ gases are stripped from the hydrotreater effluent in a conventional manner in a gas-liquid separation zone.

The product that is obtained from the process of the present invention is a colorless water-white oil and has a color of ±30 Saybolt and possesses a low absorbance of ultraviolet light. The UV analysis, pursuant to the Food and Drug Administration specification, can have a maximum value of 0.1. The product, when submitted to the test for readily carbonizable substances, which test is identified hereinbelow, can have a maximum USP-Acid Test value of 3.0.

EXAMPLE 1

In the instant example two dehazing catalysts were prepared and tested in the process of the present invention. Catalyst A was prepared by impregnating a Zeolon 200-H, support (supplied by the Norton Co. as 1/16 inch extrudates) with a palladium nitrate solution using the method of incipient wetness which resulted in a finished catalyst after drying and calcination having 0.5 wt. % Pd.

Catalyst B was prepared by a similar impregnation method except that the base or support was a blend of 50 wt. % ZSM-5 zeolite ($SiO_2/Al_2O_3=4$) and 50 wt. % PHF alumina with added $NH_3$. The blend was dried, pressed into a disc and ground to 10/20 mesh size.

A 35 USP white oil possessing the following properties set out in Table I was contacted with catalyst A and a hydrogenation catalyst similar to the one described above used in the method to prepare white oils in an isothermal downflow reactor having an inside diameter of 0.75 in., a catalyst volume of 100 cc, and a catalyst bed length of 15.25 in. The conditions included a temperature of 475° F., a pressure of 1600 psig, and a hydrogen flow rate of about 8000 SCFB.

The products were then subjected to a U.S.P. test for solid paraffin (or hereinafter the haze test) which requires a 0.5 mm black line be visible through the oil contained in a 4 ounce sample bottle after four hours immersion in an ice bath. This U.S.P. test was supplemented with an additional test involving prolonged cold storage in a refrigerator at 4° C.

Table I also sets out the results of the above tests involving catalyst A and the standard second stage white oil hydrogenation catalyst.

TABLE I

CATALYTIC DEHAZING OF 35 USP WHITE OIL AT 475° F. AND 1600 psig

| | 35 USP White Oil | | | | |
|---|---|---|---|---|---|
| RUN NO. | As Recieved | Dried[b] | 1 | 2 | 3 |
| CATALYST | | | A Pd/ H-Zeolen | A Pd/ H-Zeolon | Comparative Pd/ alumina |
| LHSV, Vo/Vc/hr | | | 1.0 | 0.25 | 0.25 |
| PRODUCT RECOVERY, WT % | | | 95.8 | 86.3 | 97.6 |
| VISCOSITY, Centistokes at 40° C. | 54.95 | | 53.97 | 57.51 | 53.93 |
| FLASH POINT, °F. | 455 | | 415 | 435 | 460 |
| POUR POINT, °F. | +5 | | −10 | −25 | +5 |
| USP HAZE TEST | PASS- | PASS- | PASS- | PASS- | PASS- |

TABLE I-continued

| CATALYTIC DEHAZING OF 35 USP WHITE OIL AT 475° F. AND 1600 psig | | | | | |
|---|---|---|---|---|---|
| | 35 USP White Oil | | | | |
| RUN NO. | As Recieved | Dried[b] | 1 | 2 | 3 |
| | SLIGHT HAZE | CLEAR | CLEAR | CLEAR | CLEAR |
| STORAGE AT 4° C.— DAYS TO CLOUDINESS[a] | 0–3 | 0–9 | 478+ | 465+ | 1–12 |

[a]Ranges given because samples were examined at irregular intervals.
[b]Dried in beaker for less than one hour; maximum temperature was about 125° C.

As can be seen from Table I white oil products dehazed in accordance with the invention (catalyst A) passed the U.S.P. haze test and remained clear for more than one year at 4° C. before being removed from refrigeration. It should also be noted that the product which had not been contacted with the dehazing catalyst, but only with the second stage white oil hydrogenation process catalyst, did not retain clarity in the prolonged low temperature storage test.

EXAMPLE 2

The present example serves to demonstrate another embodiment of the present invention wherein the dehazing catalyst and the hydrogenation catalyst are present in a single (second) reaction zone. The following Table II sets out the feed properties of the material charged to a second stage reaction zone. This particular feed oil was obtained from the effluent of a first stage desulfurization reactor in accordance with the method of the invention.

TABLE II

| | |
|---|---|
| Viscosity | 68.70 centistokes at 40° C. |
| Viscosity Index | 100 |
| Pour Point | +10°F. |
| Gravity | 30.5° API |
| Flash Pt (COC) | 408° F. |
| Saybolt Color | +16 |
| USP Haze | Pass (Slight Haze) |

Table III below sets out the characteristics of the comparative hydrogenation catalysts used in the present example.

TABLE III

| | Comparative A | Comparative B |
|---|---|---|
| Wt. % Pd | 0.55 | 0.53 |
| Surface area, $n^2/g$ | 244 | 237 |
| Pore Volume, cc/g | 0.84 | 0.80 |
| Average Pore Diameter, nm | 13.8 | 13.5 |

The following Table IV sets out the results of the runs carried out in the present example at the conditions stipulated and the same reactor described in Example 1. Note that the percentages of dehazing and hydrogenation catalyst shown in the table are on a volumetric basis.

TABLE IV

| CATALYTIC DEHAZING OF 35 USP WHITE OIL (475° F., 1600 psig, 0.25 LHSV, 8000 SCFB) | | | | |
|---|---|---|---|---|
| RUN NO. | Catalyst | Saybolt Color | Pour Point, °F., | USP Acid |
| Feed | | +16 | +10 | — |
| 4 | Comparative A | +30 | +5 | Pass |
| 5 | Top 25%-Catalyst A Bottom 75%-Comparative B | +30 | 0 | Pass |
| 6 | Mixed: 25% Catalyst A 75% Comparative B | +30 | 0 | Pass |
| 7 | Mixed: 25% Catalyst A, 75% Comparative A | +30 | −10 | Pass |
| 8 | Top 75%-Comparative A Bottom 25%-Catalyst A | +30 | −5 | Pass |
| 9 | Mixed: 33% Catalyst A and 67% Comparative A | +30 | −10 | Pass |
| 10 | Mixed: 50% Catalyst B 50% Comparative A | +30 | −35 | Pass |

TABLE IV-continued

| RUN NO. | FDA UV | USP Haze | 4° Storage-Days To Haze | Yield Wt % |
|---|---|---|---|---|
| | — | Pass-Slight Haze | 1 | |
| 4 | Pass | Pass-Slight Haze | 1 | 100 |
| 5 | Pass | Pass-Clear | 1–7 (a) | 94 |
| 6 | Pass | Pass-Clear | 1–7 (a) | 95 |
| 7 | Pass | Pass-Clear | 4–7 (a) | 97 |
| 8 | Pass | Pass-Clear | 1–7 (a) | 98 |
| 9 | Pass | Pass-Clear | 17+ (b) | 99 |
| 10 | Pass | Pass-Clear | 76 | 92 |

(a) Haze is slight compared to feed or comparative run product
(b) By 56 days a slight cloud had developed From the above Table IV, it is evident that all white oils made in accordance with the process of the invention, runs 5 through 10 remained clear in the USP haze test. Cold storage tests on material, obtained using a second stage containing 25 wt. % Pd/H-Zeolon, catalyst A, were slightly improved and materials made using 33 vol. % catalyst A dehazing catalyst in the second stage reactor had significantly improved storage life. The cold storage improvements with this feed compared to the feed used in Example 1 are less, probably because of the higher viscosity (68 vs 55 centistokes). All products tested passed the USP acid test (or carbonizable substances test) described in the UNITED STATES PHARMACOPOEIA XX (1980) pp. 432–433, the FDA UV test for polycyclic aromatics, and had +30 Saybolt color. These tests show that the dehazing catalyst did not adversely affect product quality.

Run 10 using 25 wt. % ZSM-5 dehazing catalyst, catalyst B, yielded a lower pour point product than the H-Zeolon dehazing catalyst, runs, indicating higher activity (−35° F. pour point for the ZSM-5 based catalyst versus a 0° to −10° F. pour point for the Zeolon based catalyst).

Runs 5 through 9 demonstrate that the location of the dehazing catalyst in the second stage reactor is not critical or detrimental to white oil properties in any manner.

EXAMPLE 3

In the present example the process of the invention is demonstrated by the use of a second stage reaction zone employing a hydrogenation catalyst and 25 wt. % HAMS-1B borosilicate sieve-based dehazing catalyst designated as catalyst C. The dehazing catalyst was prepared by dispersing the HAMS-1B borosilicate powder in enough Cyanamid PHF sol to give a 60 wt. % HAMS-1B and 40 wt. % PHF alumina support. 0.5 wt. % platinum was incorporated into this support by using platinum nitrate solutions in accordance with the incipient wetness impregnation procedure. Two different feeds were employed in the present example. These feeds are derived from the effluent of a first stage desulfurization zone as stipulated in the process of the invention. Feed inspections are set forth below in Table V.

TABLE V

INTERMEDIATE WHITE OILS

| | Run 11 | Run 12 |
|---|---|---|
| API Gravity | 30.5 | 31.3 |
| Viscosity, cSt | | |
| 40° C. | 68.7 | 65.8 |
| 100° C. | 8.81 | 8.68 |
| Viscosity Index | 100 | 104 |
| Flash Point-COC, °C. | 206 | — |
| Pour Point, °F. | +10 | +10 |
| Cloud Point, °F. | +10 | +26 |
| USP Opalescence | pass (sl. haze) | fail |
| USP Acid | 7.5 (fail) | 8.0 (fail) |
| Color[c] | | |
| FDA UV Test[d] | 1.7 (fail) | 3.1 (fail) |
| Saybolt Color | +17 | +24[b] |

[a]This sample was visibly hazy at room temperature.
[b]After filtration through 5 um filter.
[c]Specification is less than 3.0 ASTM.
[d]Specification is less than 0.1.

The reactor employed in the present example and utilized as the second reaction zone possessed an inside diameter of 0.49 inches contained a catalyst volume of 32 ccs and had a catalyst bed length of 12.5 inches. The runs were carried out at standard second stage white oil conditions including, a pressure of 1600 psig., a temperature of 475° F., a LHSV of 0.26, and a hydrogen circulation rate of 7,500 to 8,000 SCFB. Haze removal from the white oils was measured by the reduction of pour and cloud points by the USP solid paraffin or haze test. The USP haze test as previously mentioned requires that the oil remains sufficiently clear in a standard sample bottle such that after 4 hours immersion in an ice water bath a black line 0.5 millimeters wide remains clearly visible through the oil. Some products were also stored in a refrigerator at 4° C. to observe long-term haze formation. The effects of dehazing catalysts on other important white oil product properties were measured by the USP carbonizable substances (acid) test, the FDA UV test for polycyclic aromatics in medicinal white oils and Saybolt color. An ASTM color of less than (L) 3.0 is satisfactory in the USP acid test. A UV absorbance of less than 0.1 is satisfactory in the FDA UV test. All white oils must have a +30 Saybolt color or better. The following Table VI sets out the results of these tests.

TABLE VI

CATALYTIC DEHAZING OF INTERMEDIATE WHITE OIL

Conditions: 1600 psig, 475° F., 0.26 Vo/Vc/hr, 7500–8000 SCFG Gas Rate

| RUN | 11 | 12 |
|---|---|---|
| Days on Stream | 5 | 6 |
| Catalyst [a]-Top 42% Bottom 58% Aero | 60/40 HAMS-1B/$Al_2O_3$ 100 Alumina | Same as run 11 |
| Product Analyses | | |
| Cloud Point, °F. | +2 | +12 |
| Pour Point, °F. | 0 | 0 |
| USP Haze | Clear | Pass (almost clear) |
| USP Acid[b] | L2 (pass) | L1.5 (pass) |
| FDA UV | 0.039 (pass) | 0.107 (borderline fail) |
| Saybolt Color | +30 | +30 |
| Yield, Wt % | 99+ | 99+ |
| 4° C. Storage Days | — | Trace of cloudiness within 17 days, no change at 155 days |

[a]All catalysts contained 0.5% Pd.
[b]L = Less than.

As can be noted from the above table the borosilicate dehazing catalyst utilized in accordance with the process of the invention was effective for removing haze from the white oils. The color and aromatic content of the product of Run 11 was similarly satisfactory. The hazier feed, the feed used in Run 12 was also upgraded to pass the haze test. This product also passed Saybolt color and the USP acid test but marginally failed the FDA UV test. The feed used in Run 12, however, had more aromatics than the feed used in Run 11 as shown by the USP acid and FDA UV results as shown in above Table V. The feed used in Run 12 was not a suitable feed for the final hydrogenation stage because of its low quality.

What is claimed is:

1. A process for preparing a haze-free white mineral oil possessing an ultraviolet absorbance of less than 0.1 which comprises the steps of:
   (a) contacting a dewaxed lube oil with a sulfactive hydrogenation catalyst in the presence of hydrogen under hydrogenation and desulfurization conditions to produce a desulfurized effluent;
   (b) contacting the desulfurized effluent in the presence of hydrogen with a hydrogenation catalyst under hydrogenation conditions;
   (c) contacting the hydrogenated effluent in the presence of hydrogen with a dehazing catalyst comprising a Group VIII metal incorporated with a shape-selective molecular sieve component having a pore size that permits the entry of normal aliphatic compounds and slightly branched aliphatic compounds and substantially exclude all compounds containing at least a quaternary carbon atom and compounds having a molecular dimension equal to or substantially greater than a quaternary carbon atom wherein said pore size is about 5 angstroms under hydrogenation conditions including a temperature range of about 400° to about 475° F., a hydrogen partial pressure range of about 1000 to about 2000 psig., and a liquid hourly space velocity of about 0.1 to about 0.1.

2. The process of claim 1 wherein the hydrogenation catalyst comprises a Group VIII noble metal deposited on a large-pore-diameter alumina.

3. The process of claim 1 wherein said shape-selective molecular sieve is ZSM-5.

4. The process of claim 1 wherein said shape-selective molecular sieve is a crystalline borosilicate molecular sieve.

5. The process of claim 3 wherein the Group VIII metal of the dehazing catalyst is selected from the group consisting of platinum and palladium.

6. The process of claim 4 wherein the Group VIII metal of the dehazing catalyst is a Group VIII metal selected from the group consisting of platinum and palladium.

7. A process for preparing a haze-free white mineral oil possessing an ultraviolet absorbance of less than 0.1 which comprises the steps of:

(a) contacting a dewaxed lube oil with a sulfactive hydrogenation catalyst in the presence of hydrogen under hydrogenation and desulfurization conditions to produce a desulfurized effluent;

(b) contacting the desulfurized effluent in the presence of hydrogen with a hydrogeneration catalyst, and a dehazing catalyst comprising a molecular sieve component having a pore size that permits the entry of normal aliphatic compounds and slightly branched aliphatic compounds and substantially exclude all compounds containing at least a quaternary carbon atom and compounds having a molecular dimension equal to or substantially greater than a quaternary carbon atom wherein said pore size is about 5 anstroms under hydrogenation conditions including a temperature range of about 400° to about 475° F., a hydrogen partial presence range of about 1000 to about 2000 psig., and a liquid hourly space velocity of about 0.1 to about 1.0, said dehazing catalyst being present in an amount ranging from about 10 to about 50% by weight.

8. The process of claim 7 wherein the dehazing catalyst is present in an amount ranging from about 15 to about 35 % by weight.

9. The process of claim 7 wherein the hydrogenation catalyst comprises a Group VIII noble metal deposited on a large-pore-diameter alumina and the dehazing catalyst consists essentially of said Group VIII metal incorporated with a crystalline borosilicate molecular sieve.

10. The process of claim 7 wherein the hydrogenation catalyst comprises a Group VIII noble metal deposited on a large-pore-diameter alumina and the dehazing catyalst consists essentially of said Group VIII metal incorporated with a ZSM-5 zeolite.

* * * * *

UNITED STATES PATENT OFFICE

CERTIFICATE OF CORRECTION

Patent No. 4,810,355 Dated March 7, 1989

Inventor(s) P. Donald Hopkins

It is certified that error appears in the above-identified patent and that said Letters Patent is hereby corrected as shown below:

| Col. | Line | |
|---|---|---|
| 16 | 65 | "0.1" should be --1.0-- |

Signed and Sealed this

Sixth Day of November, 1990

*Attest:*

HARRY F. MANBECK, JR.

*Attesting Officer*

*Commissioner of Patents and Trademarks*